US010869570B2

(12) United States Patent
Dunkelberger et al.

(10) Patent No.: US 10,869,570 B2
(45) Date of Patent: Dec. 22, 2020

(54) SECURE DELIVERY RECEPTACLE

(71) Applicants: David Kirk Dunkelberger, Oak Ridge, NC (US); Jacob Kirk Dunkelberger, Greensboro, NC (US); Joseph Dean Dunkelberger, Greensboro, NC (US); John Gilbert Dunkelberger, Kernersville, NC (US)

(72) Inventors: David Kirk Dunkelberger, Oak Ridge, NC (US); Jacob Kirk Dunkelberger, Greensboro, NC (US); Joseph Dean Dunkelberger, Greensboro, NC (US); John Gilbert Dunkelberger, Kernersville, NC (US)

( * ) Notice: Subject to any disclaimer, the term of this patent is extended or adjusted under 35 U.S.C. 154(b) by 5 days.

(21) Appl. No.: 16/264,276

(22) Filed: Jan. 31, 2019

(65) Prior Publication Data

US 2019/0231104 A1 Aug. 1, 2019

Related U.S. Application Data

(60) Provisional application No. 62/646,472, filed on Mar. 22, 2018, provisional application No. 62/624,268, filed on Jan. 31, 2018.

(51) Int. Cl.

| | |
|---|---|
| ***A47G 29/124*** | (2006.01) |
| ***A44B 19/30*** | (2006.01) |
| ***E05B 73/00*** | (2006.01) |
| *A47G 29/20* | (2006.01) |

(52) U.S. Cl.

CPC ..... *A47G 29/124* (2013.01); *A44B 19/30* (2013.01); *E05B 73/00* (2013.01); *A47G 29/20* (2013.01)

(58) Field of Classification Search

CPC ..... B65D 33/25; B65D 33/2508; B65D 33/2566; B65D 33/2591; B65D 33/2516; B65D 33/2525; B65D 33/2533; B65D 33/2541; B65D 33/255; B65D 2501/2449; B65D 2501/24496; A47G 29/124; A47G 29/20; E05B 73/00–02; A44B 19/30

USPC ..... 220/477, 478, 479, 480, 481, 482, 483, 220/375, 249

See application file for complete search history.

(56) References Cited

U.S. PATENT DOCUMENTS

| | | | | |
|---|---|---|---|---|
| 4,694,503 | A * | 9/1987 | Hydorn | D06F 95/004 248/100 |
| 5,816,982 | A * | 10/1998 | Croushore | A63B 69/12 482/55 |
| 6,161,959 | A * | 12/2000 | Abraham | A44B 19/301 24/387 |
| 8,186,514 | B2 * | 5/2012 | Bowers | A45C 7/0095 206/320 |
| 9,050,489 | B2 * | 6/2015 | Bell | A63B 69/14 |
| 9,775,440 | B1 * | 10/2017 | Chon | A47C 20/021 |
| 2003/0052035 | A1 * | 3/2003 | Dickinson | B65D 5/4233 206/522 |
| 2003/0231809 | A1 * | 12/2003 | Bentsen | B65D 33/2591 383/59 |
| 2008/0161167 | A1 * | 7/2008 | Ottaviani | A63B 69/12 482/55 |

(Continued)

*Primary Examiner* — Kareen K Thomas

(57) ABSTRACT

A secure delivery system has a receptacle formed from sturdy, reinforced fabric with a single zippered opening, a zipper closing the opening having a locking slider, a tether attached securely to the receptacle, and an anchor enabled to attach securely to a post, wall or door.

7 Claims, 8 Drawing Sheets

(56) References Cited

U.S. PATENT DOCUMENTS

| | | | | |
|---|---|---|---|---|
| 2011/0168584 | A1* | 7/2011 | Torrellas | A47G 25/54<br>206/287 |
| 2012/0015783 | A1* | 1/2012 | Brown | A63B 21/0088<br>482/74 |
| 2012/0102811 | A1* | 5/2012 | Waugh | F41B 13/10<br>43/6 |
| 2016/0151688 | A1* | 6/2016 | Wark | A45C 13/02<br>224/274 |
| 2020/0060460 | A1* | 2/2020 | Farrar | A47G 29/141 |

* cited by examiner

SECURE DELIVERY RECEPTACLE

CROSS-REFERENCE TO RELATED DOCUMENTS

The present application claims priority to U.S. Provisional Patent Application Ser. 62/624,268 filed Jan. 31, 2018. Priority is also claimed to U.S. Provisional Patent Application Ser. 62/646,472, filed Mar. 22, 2018. All disclosure of the parent application is incorporated at least by reference.

BACKGROUND OF THE INVENTION

1. Field of the Invention

The present invention is in the technical area of container apparatus, and pertains more particularly to secure package containers.

2. Description of Related Art

It is well-known that Internet commerce has been a growing phenomenon for quite some time, and that purchases from Internet-enabled merchants are typically delivered to customers through the Post Office or package delivery services, such as FedEx. Many people are not at home when packages are delivered, and may authorize delivery services to leave packages on a porch or doorstep. This practice has led to a criminal enterprise with thieves stealing packages from people's porches and doorsteps.

What is critically needed is a secure receptacle into which delivery personnel may deposit packages, and lock the receptacle, so a thief may not freely take the package.

BRIEF SUMMARY OF THE INVENTION

In one embodiment of the invention a secure delivery system is provided, comprising a receptacle formed from sturdy, reinforced fabric with a single zippered opening, a zipper closing the opening having a locking slider, a tether attached securely to the receptacle, and an anchor enabled to attach securely to a post, wall or door.

In one embodiment the tether is a metal rod secured through fabric of the receptacle to a metal plate within the receptacle. Also in one embodiment the anchor is a unit having a metal body to which the tether is joined, and a keyed mechanism adapted to lock the anchor unit to a post of an anchor plate fasted to a surface by conventional screws, heads of the screws covered by the metal body with the metal body locked to the post of the anchor plate. In one embodiment the anchor is a door bracket adapted to engage a hinged edge of a door, with the tether securely anchored to the bracket, such that the tether and attached receptacle are captured and not removable with the door closed and locked. In one embodiment the system further comprises a support attached to the receptacle at and end opposite the attachment of the tether, the support adapted to loop over a doorknob to support the receptacle. And in one embodiment the system further comprises spring elements implemented along edges of the zippered opening of the receptacle, such that with the zipper withdrawn the spring strips hold the zippered opening partially open.

In one embodiment the locking slider comprises an upper portion having a key-lock mechanism engaging and turning a vertically-oriented spindle having a cam head, and first channels on an underside of the upper portion defining one part of converging ribbon channels for guiding ribbons of a zipper, and a lower portion having second channels matching the first channels, such that fastening the upper and lower portions together forms completed converging ribbon channels guiding opening and closure of a zipper as the zipper lock mechanism is translated along the zipper. The lower portion further having a spring-loaded pivoted pawl operated by the cam head of the spindle passing through a hole in the lower portion from the upper portion, to lock and unlock and end of the pawl onto the zipper.

In one embodiment a zipper lock mechanism is provided, comprising an upper portion having a key-lock mechanism engaging and turning a vertically-oriented spindle having a cam head, and first channels on an underside of the upper portion defining one part of converging ribbon channels for guiding ribbons of a zipper, and a lower portion having second channels matching the first channels, such that fastening the upper and lower portions together forms completed converging ribbon channels guiding opening and closure of a zipper as the zipper lock mechanism is translated along the zipper, the lower portion further having a spring-loaded pivoted pawl of which engages the zipper teeth to inhibit reverse tread of the locking mechanism. The pawl operated by the cam head of the spindle passing through a hole in the lower portion from the upper portion, to pivot the pawl and release the opposing end of the pawl from the zipper teeth enabling free translation of the locking mechanism along the zipper.

DETAILED DESCRIPTION OF THE INVENTION

Figure 1:
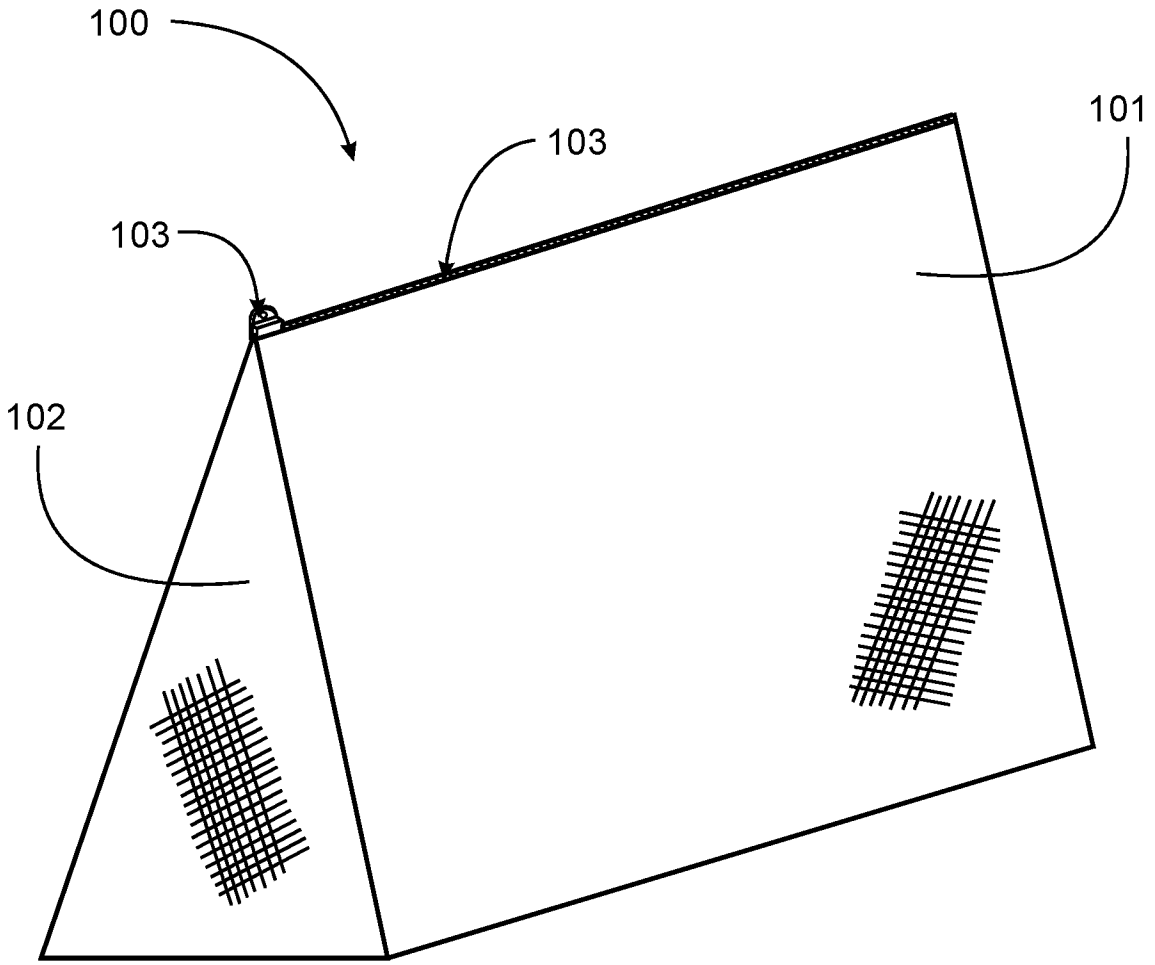
FIG. 1 is a perspective view of a secured delivery receptacle in an embodiment of the invention.

FIG. 1 is a perspective view of a secured delivery receptacle 100 in an embodiment of the invention. In this example receptacle 100 is a fabric receptacle having sides 101 (one of two shown), triangular ends 102 (one of two shown), and a rectangular bottom (not seen in FIG. 1). In this example the four intersecting edges of the rectangular bottom of the receptacle are reinforced with rigid wire or rods, as are the sides of the triangular ends. The rods or wires give shape to the receptacle, and may in some embodiments be sewn into seams along the joining edges of panels of the receptacle.

The fabric in this example is reinforced and very difficult to cut or tear, in some embodiments having metal strands woven into the fabric, for example. A top of receptacle 100 is closed by a strong zipper 103 having a zipper slide 103 capable of being locked closed, or in any position along a length of the zipper. Several variations of locking zippers are commercially available, including having a zipper pull that has a hole through which a hasp of a padlock may passed, and the padlock locked. The purpose is to leave the receptacle open and available for a delivery person when a delivery is expected. And the delivery person, after depositing a package or other article in the receptacle, may close the zipper and lock it, so wandering thieves may not abscond with the delivered package or article.

Figure 2:
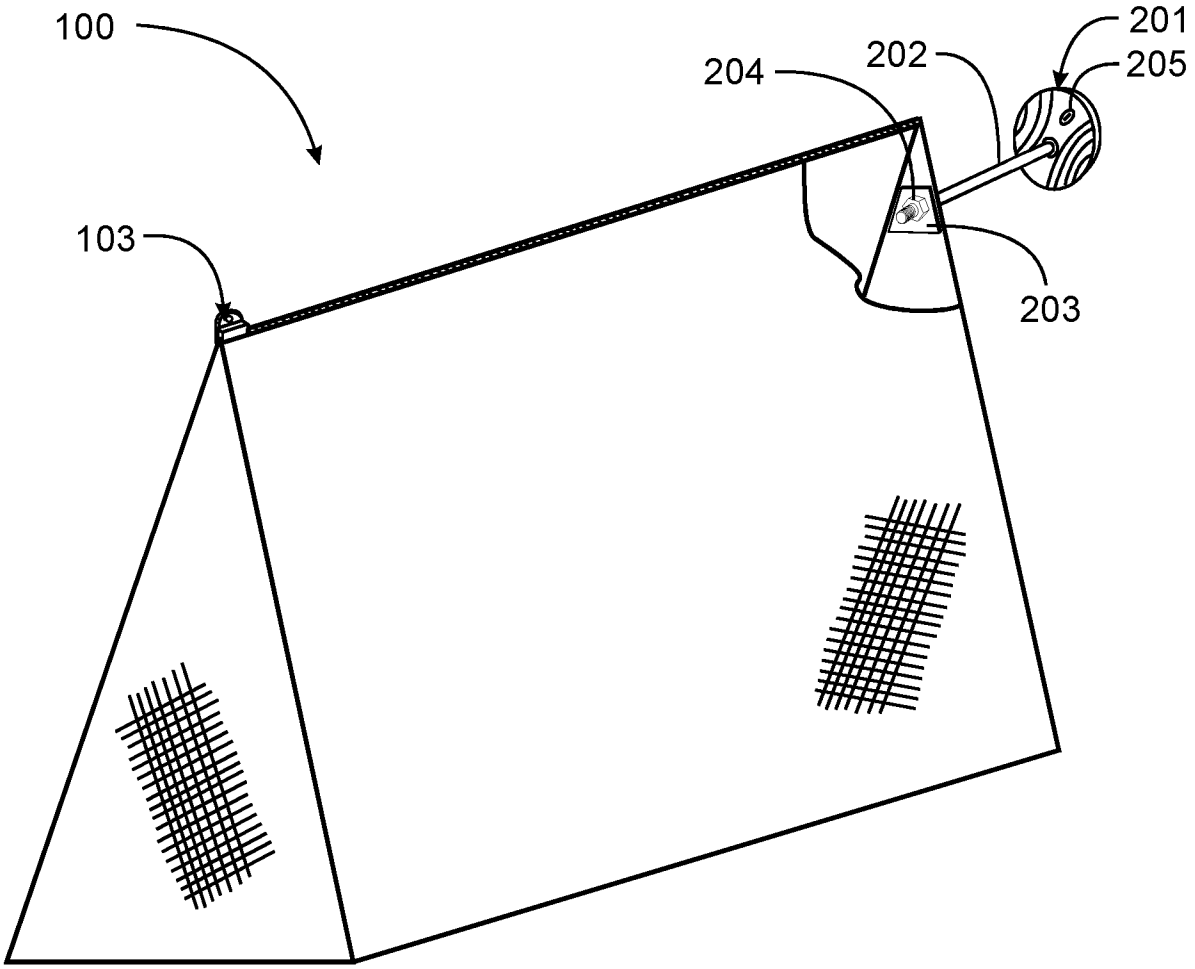
FIG. 2 is a perspective view of the secured delivery receptacle of FIG. 1 tethered to an anchor mechanism.

Of course the secured delivery receptacle, to be secure, must be anchored somehow to the location where the receptacle may be positioned for delivery. FIG. 2 is a perspective view of the receptacle of FIG. 1 secured by a wall mount anchor 201 to a wall or to such as a post.

FIG. 2 is a perspective view of the secured delivery receptacle of FIG. 1 tethered to an anchor mechanism 201, which anchors by a connecting tether 202 to a post or a wall, for example. Tether 202 may be in some embodiments a rod or a cable, or even a chain, and may take different forms in different embodiments. Tether 202 is shown as a rod in this example. Tether 202 is secured inside of anchor mechanism 201 by a locking mechanism actuated by a key used in key slot 205. A mechanism for the locking is described more fully below with reference to FIG. 3.

Tether 202 in this example passes through a hole in a fastening plate 203, with a male-threaded end, and is secured with a hex nut 204. The skilled person will understand that this is a convenient way to secure the tether to the fabric receptacle of the receptacle, and that there may be a variety of ways the attachment may be accomplished. In use in the form shown in FIG. 2 the anchor mechanism 201 stays mounted to a post or a wall, such as by a door where packages may be delivered. A user, expecting delivery of a package, will bring the delivery receptacle to the point of the anchor mechanism, and secure the tether 202 into the anchor mechanism, locking it in place. The user will leave the receptacle open by drawing back zipper 103. When a delivery person comes, that person will place the package in the open receptacle an draw the zipper closed and lock it. The package is then secure. The recipient user may then, at a later time, unlock and open the zipper, take out the delivered package, and either unlock the tether and remove the receptacle, or leave the receptacle for another expected delivery.

Figure 3:
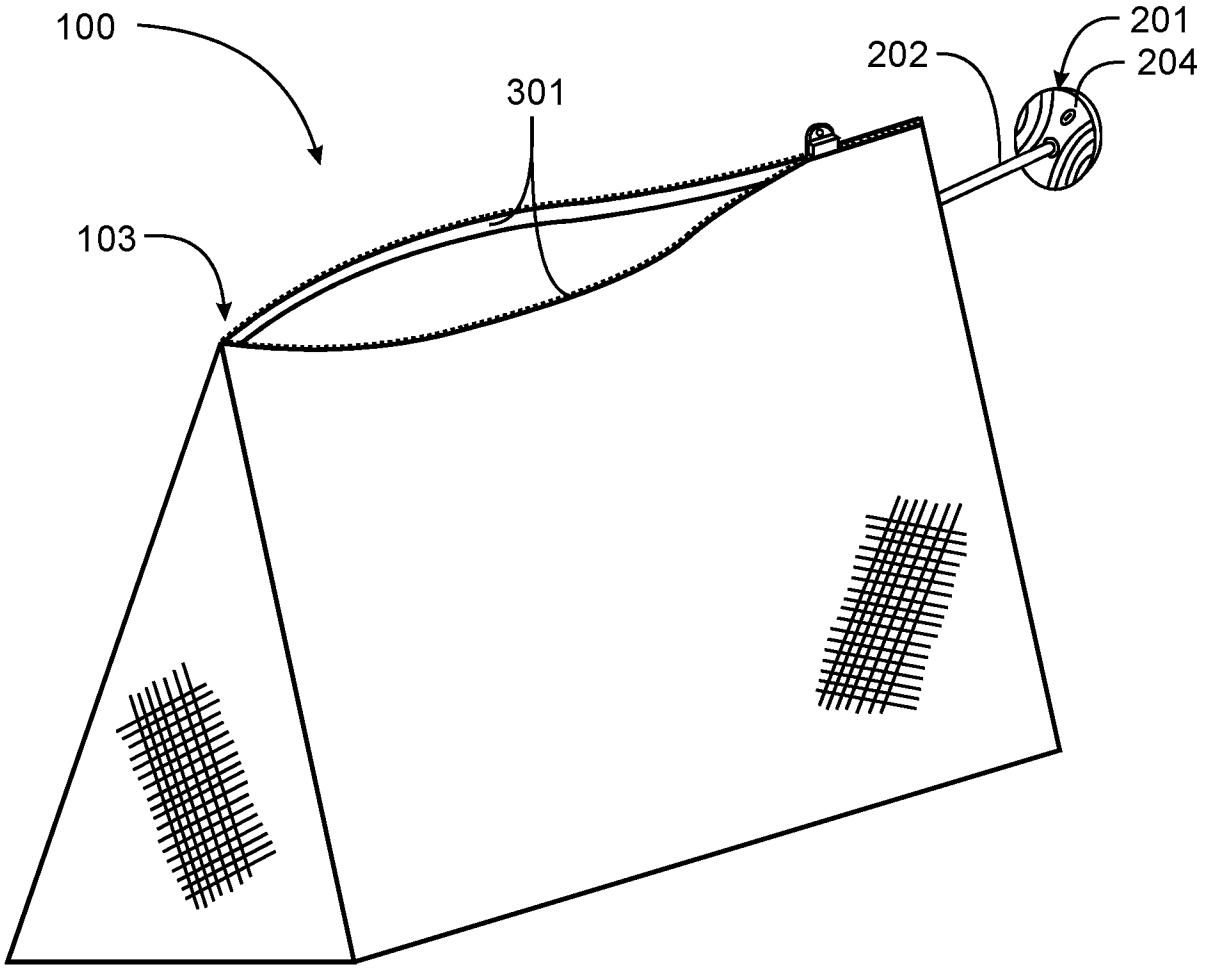
FIG. 3 is a perspective view of the secured delivery receptacle of FIG. 1 tethered to an anchor mechanism, and left open in an embodiment of the invention.

FIG. 3 is a perspective view of the secured delivery receptacle of FIG. 1 tethered to an anchor mechanism, and left open in an embodiment of the invention. In this example the edges of the receptacle along the upper edges where the zipper is implemented have opposing spring elements 301 that urge the receptacle open when the zipper is open as shown. Closing the zipper flexes the spring elements into a straight and parallel relationship, which is the default position. The spring elements may be constrained in sleeves along the edges proximate the zipper.

Figure 4:
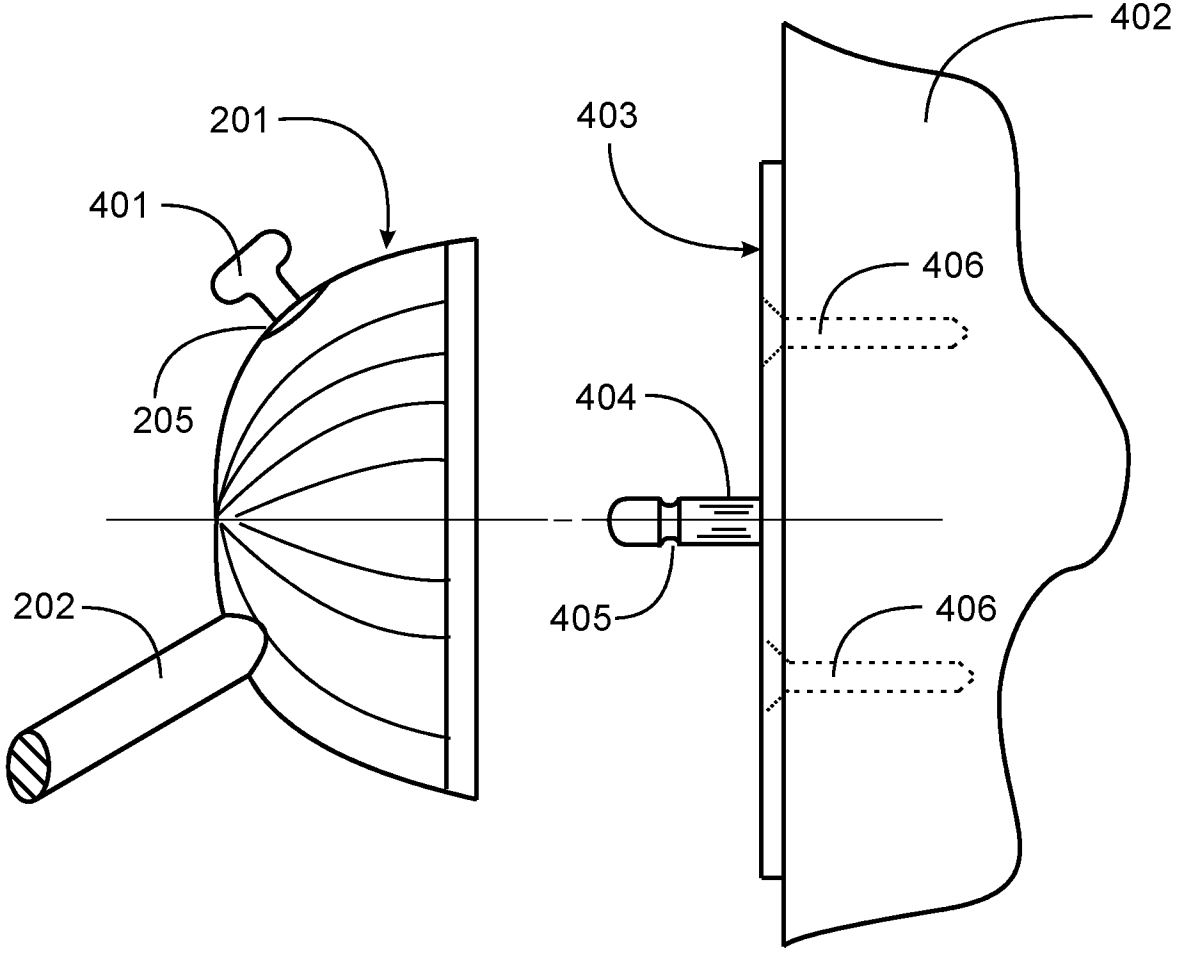
FIG. 4 is a side elevation and exploded view of anchor mechanism in an embodiment of the invention.

FIG. 4 is a side elevation and exploded view of anchor mechanism 201 illustrating how the mechanism anchors to a surface of a wall or a post 402. An anchor plate 403 is secured to a surface of the wall or post by conventional fasteners, such as screws 406. Anchor plate 403 has a locking post 404 extending away from the surface with a circumferential groove 405. Anchor mechanism 201 has a lock mechanism inside that engages groove 405, and key 401 turning in key slot 205 engages and disengages the locking to post 404.

Figure 5:
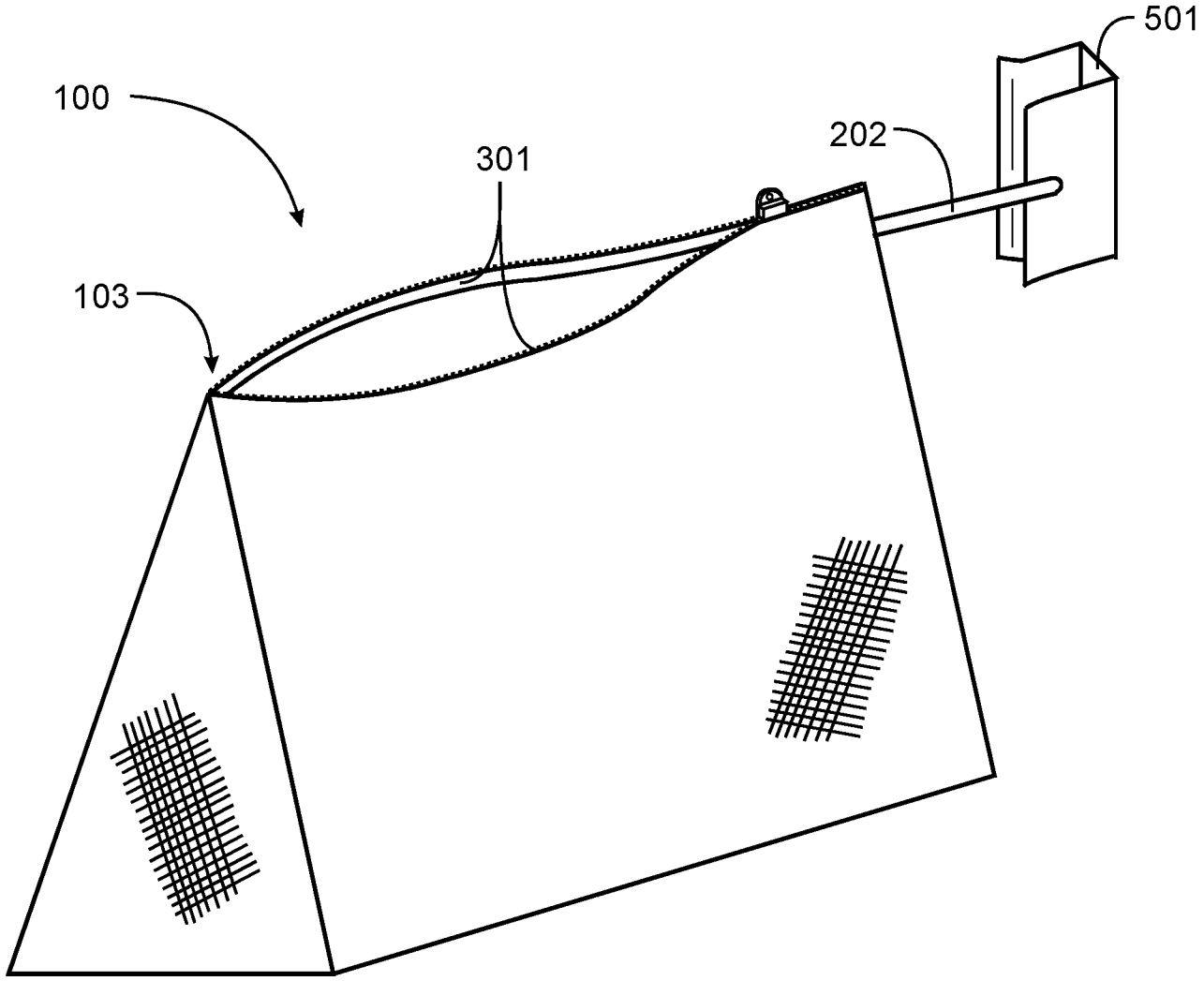
FIG. 5 illustrates a secure delivery receptacle anchored to a door bracket in an embodiment of the invention.
Figure 6:
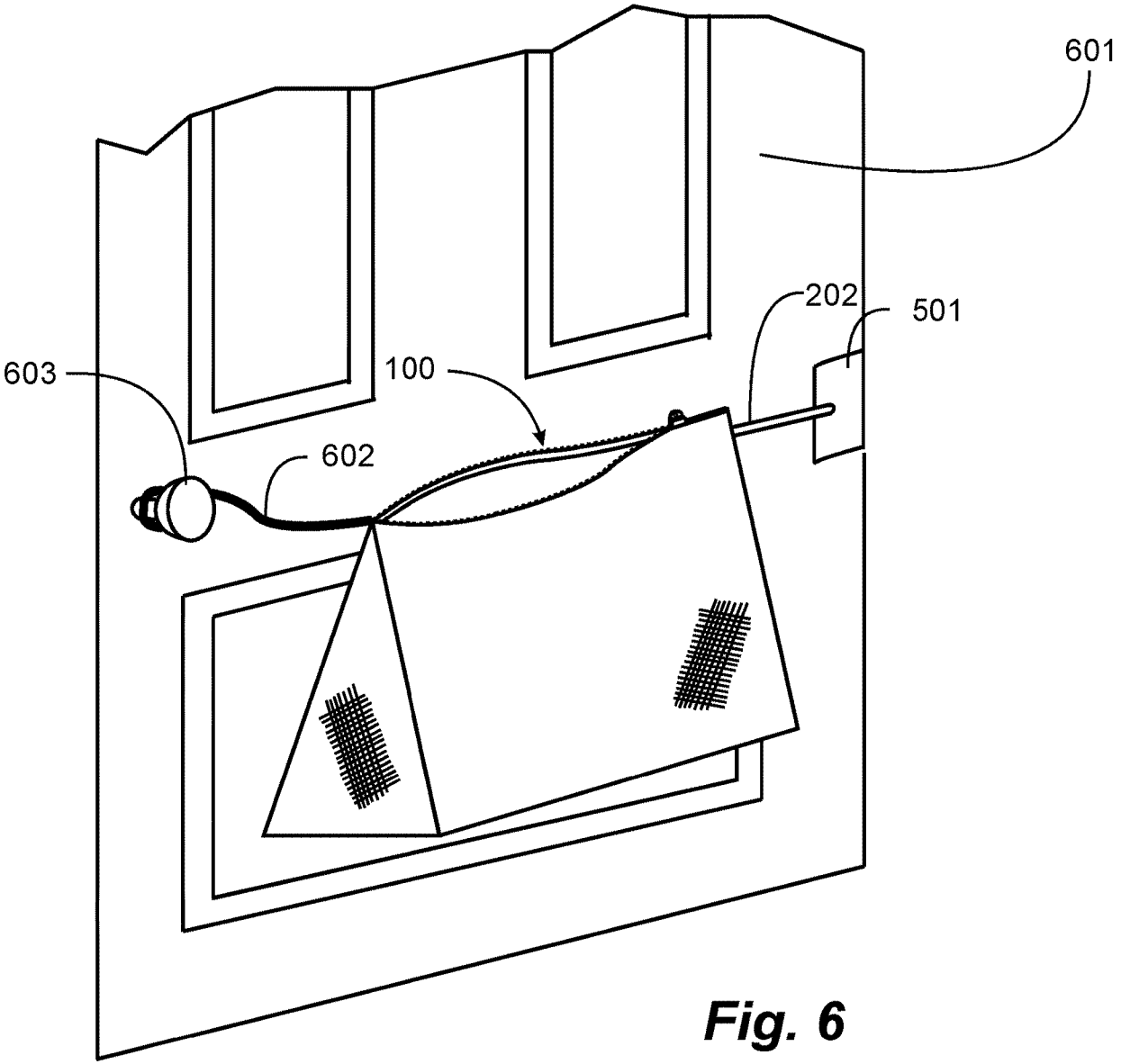
FIG. 6 illustrates the secure delivery receptacle of FIG. 5 engaged with a door in an embodiment of the invention.

FIG. 5 illustrates another way that a secure delivery receptacle in an embodiment of the invention may be anchored. In this example tether 202 is secured to a door bracket 501 such as by rivets or by welding. It is important that the connection between the tether and the bracket be strong and secure so that a potential thief cannot break or cut the tether from the bracket. FIG. 6 illustrates the door bracket engaged to the hinged edge of a door with the receptacle connected by the tether positioned in front of the door. The user may open the door far enough to fit the bracket on the edge of the door, after which the door may be closed, which secures the bracket in place and establishes the receptacle in a manner that it may not be removed without opening the door. This example provides a way to anchor the receptacle with no damage to the door.

FIG. 6 illustrates a secured delivery receptacle anchored to a door bracket, as in FIG. 5, with door bracket 501 engaged with the hinged edge of a door 601, securing receptacle 100 by tether 202. The receptacle is shown open, and the end of the receptacle opposite the tether is supported in a doorknob of the door by a bungee cord 602 in this example. In other embodiments a doorknob loop may be sewn onto the receptacle for this purpose.

Figure 7:
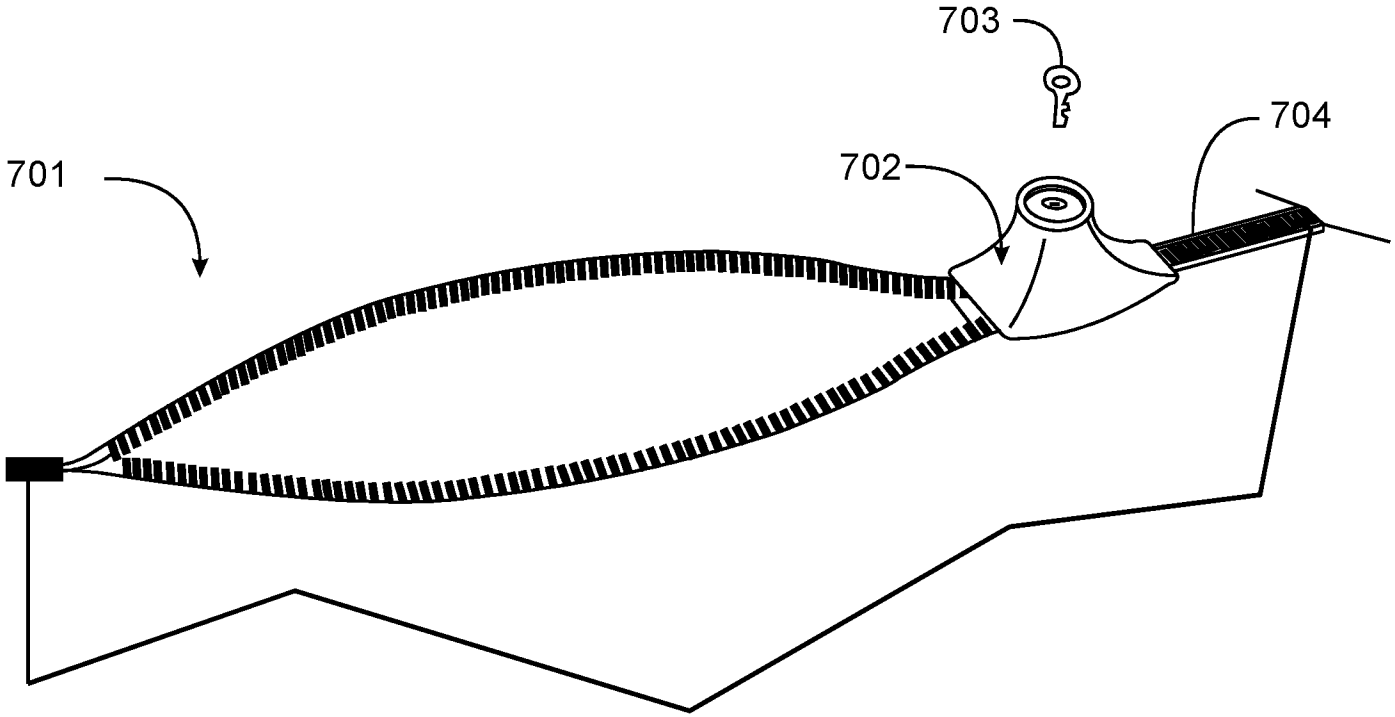
FIG. 7 is a perspective view of a portion of a secure delivery receptacle having a zipper and a locking zipper-closure mechanism in an embodiment of the invention.

In one embodiment of the invention a unique locking zipper closure mechanism is provided. FIG. 7 is a perspective view of a portion of a secure delivery receptacle 701 having a zipper 704 and locking zipper-closure mechanism 702 shown in a position with zipper 704 only partially closed. The mechanism is unlocked by a key 703. The locking mechanism in embodiments of the invention is capable of locking the zipper in any position, as opposed to conventional apparatus which may lock only with the zipper fully closed.

Figure 8B:
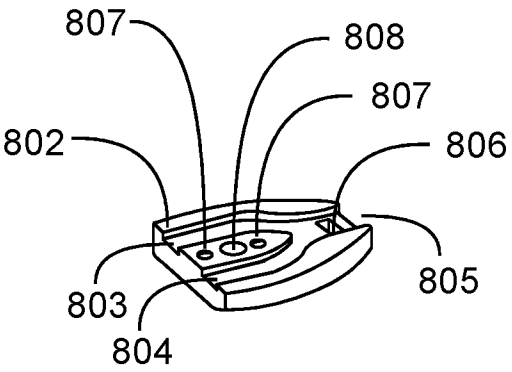
FIG. 8B is a perspective view of a lower portion of the locking zipper closure mechanism of FIG. 8A, with an upper portion removed.
Figure 8A:
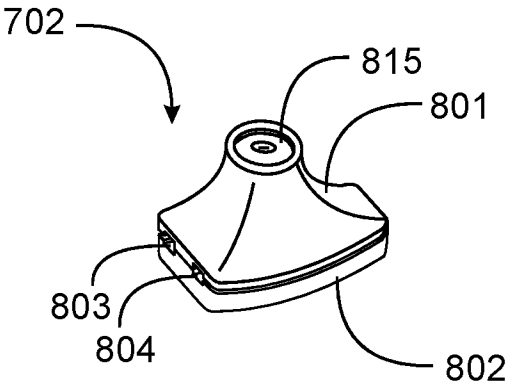
FIG. 8A is a perspective view of the locking zipper closure mechanism of FIG. 7 in an embodiment of the invention.

FIG. 8A is a perspective view of mechanism 702, including an upper portion 801 and a lower portion 802, connected together comprising the mechanism 702. The two portions are joined by two screws engaging from below the lower portion, and together form zipper ribbon channels, two on the open zipper side, and one on the closed zipper side, which is common for zipper closures. The opposite sides of the zipper are guided in the separate channels, which come together as the pull is moved along the zipper, and the sides of the zipper are engaged and pass out the single channel as a closed zipper. Entrance channels 803 and 804 are seen in FIG. 8A.

FIG. 8B is a perspective view of lower portion 802 of the locking zipper closure mechanism 702 of FIG. 8A, with upper portion 801 removed. The shape of the zipper ribbon channels can be seen as formed in the upper surface of portion 802, joining entrance channels 803 and 804 to exit channel 805. Two screw holes 807 are the holes through which screws pass from below to join the upper and lower portions of mechanism 702. Hole 808 is a hole for passage of a lock spindle, described more fully below, which is turned by key 703, and, through a cam surface on an end away from the key, raises and lowers one end of a pivoted pawl, that serves to engage the teeth of the zipper in a locked position.

Figure 8C:
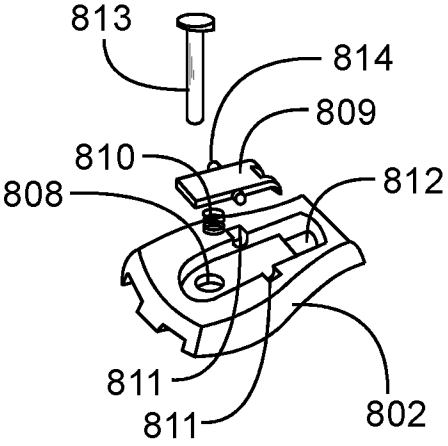
FIG. 8C is a perspective view of the lower portion of FIG. 8B, illustrating elements providing a locking function.

FIG. 8C is a perspective view of underside of portion 802 of FIG. 8B, illustrating elements that operate together to lock and unlock the zipper closure mechanism 702. It is important to note that this view is upside-down from the view of FIG. 8B. The mechanisms depicted in FIG. 8C are operating in the bottom of the lower portion of the locking zipper closure mechanism 702. A cavity is formed in the bottom of portion 802, as shown, and there are pivot cradles 811 to engage pivot cylinders 814 extending from opposite sides of a pawl element 809. With pawl element 809 in place in the cavity, a compression spring 810 urges a forward portion of the pawl through opening 812 to engage the closed zipper, which locks the zipper closure mechanism 702 to the zipper.

A lock spindle 813, as an elongated rod, extends from key mechanism 815 (see FIG. 8A) into the cavity under portion 802, through hole 808, which also passes through upper portion 801. The cam head of spindle 813 overlaps one end of pawl 809, so as the key turns spindle 813, the pawl is rotated a few degrees around a horizontal axis through the cradles 811. This motion causes the tip end of pawl 809, through opening 812, to disengage the closed zipper, unlocking the zipper pull mechanism from the zipper.

Spring 810 acts to keep the mechanism locked, and inserting and turning the key unlocks the mechanism and enables a user to open and close the zipper. As stated above, this mechanism can be locked with the zipper at any position, fully open, fully closed, or at any point in between. In one embodiment, the locking mechanism, in the locked position, may still translate in a direction that closes the zipper while prohibiting translation in an opposite direction allowing opening of the zipper. In this embodiment an individual may leave the bag secured to the door, as described above, with the lock in the locked position when the locking mechanism is at an end of the zipper leaving the zipper completely unzipped. When an item is placed in the receptacle, one need only translate the locking mechanism to an opposing end of the zipper thereby closing and locking the zipper in a closed position. In this manner, if an item only partially fits into the receptacle, wherein a portion of the item may extend out of the receptacle, the locking mechanism may be translated along the zipper up to the portion of the item extending out of the bag, thereby prohibiting the item from being removed from the receptacle.

The skilled person will understand that the embodiments and elements illustrated and described herein are exemplary only, and that many alterations may be made within the scope of the invention. Such receptacles may take many different shapes, for example, and there are a variety of fabrics that might be used. There are also a variety of ways that locking mechanisms may be implemented within the scope enabled by the examples described herein. The scope of the invention is limited only by the claims below.

We claim:

1. A secure delivery system, comprising:

a receptacle formed from sturdy, reinforced fabric with a single zippered opening, a zipper closing the opening having a locking slider;

a metallic rod secured through layers of the reinforced fabric forming a tether attached securely to a metallic plate within the receptacle; and an anchor enabled to attach securely to a post, wall or door.

2. The secure delivery system of claim 1 wherein the anchor is a unit having a metal body to which the tether is joined, and a keyed mechanism adapted to lock the anchor unit to a post of an anchor plate fasted to a surface by conventional screws, heads of the screws covered by the metal body with the metal body locked to the post of the anchor plate.

3. The secure delivery system of claim 1 wherein the anchor is a door bracket adapted to engage a hinged edge of a door, with the tether securely anchored to the bracket, such that the tether and attached receptacle are captured and not removable with the door closed and locked.

4. The secure delivery system of claim 3 further comprising a support attached to the receptacle at and end opposite the attachment of the tether, the support adapted to loop over a doorknob to support the receptacle.

5. The secure delivery system of claim 1 further comprising spring elements implemented along edges of the zippered opening of the receptacle, such that with the zipper withdrawn the spring strips hold the zippered opening partially open.

6. The secure delivery system of claim 1 wherein the locking slider comprises an upper portion having a key-lock mechanism engaging and turning a vertically-oriented spindle having a cam head, and first channels on an underside of the upper portion defining one part of converging ribbon channels for guiding ribbons of a zipper, and a lower portion having second channels matching the first channels, such that fastening the upper and lower portions together forms completed converging ribbon channels guiding opening and closure of a zipper as the zipper lock mechanism is translated along the zipper, the lower portion further having a spring-loaded pivoted pawl operated by the cam head of the spindle passing through a hole in the lower portion from the upper portion, to disengage the pawl from the closed zipper, allowing free travel of the locking mechanism along the zipper.

7. A zipper lock mechanism, comprising:

an upper portion having a key-lock mechanism engaging and turning a vertically-oriented spindle having a cam head, and first channels on an underside of the upper portion defining one part of converging ribbon channels for guiding ribbons of a zipper; and a lower portion having second channels matching the first channels, such that fastening the upper and lower portions together forms completed converging ribbon channels guiding opening and closure of a zipper as the zipper lock mechanism is translated along the zipper, the lower portion further having a spring-loaded pivoted pawl which ratchets along the closed zipper preventing reverse travel along the zipper of the locking mechanism, and the pawl operated by the cam head of the spindle passes through a hole in the lower portion from the upper portion, to engage and disengage the pawl from the zipper.

* * * * *